US007121263B2

(12) United States Patent
Eser

(10) Patent No.: US 7,121,263 B2
(45) Date of Patent: Oct. 17, 2006

(54) DEVICE AND METHOD FOR REGULATING THE CONTROL VALVE OF A HIGH-PRESSURE PUMP

(75) Inventor: Gerhard Eser, Hemau (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/498,248

(22) PCT Filed: Dec. 6, 2002

(86) PCT No.: PCT/DE02/04501

§ 371 (c)(1),
(2), (4) Date: Apr. 29, 2005

(87) PCT Pub. No.: WO03/054381

PCT Pub. Date: Jul. 3, 2003

(65) Prior Publication Data

US 2005/0224049 A1 Oct. 13, 2005

(30) Foreign Application Priority Data

Dec. 20, 2001 (DE) ..... 101 62 988

(51) Int. Cl.
*F02M 57/02* (2006.01)

(52) U.S. Cl. ..... 123/446; 123/496

(58) Field of Classification Search ..... 123/446, 123/447, 496
See application file for complete search history.

(56) References Cited

U.S. PATENT DOCUMENTS

| | | | | |
|---|---|---|---|---|
| 4,643,155 | A * | 2/1987 | O'Neill | 123/506 |
| 5,058,553 | A * | 10/1991 | Kondo et al. | 123/456 |
| 5,271,366 | A * | 12/1993 | Shimada et al. | 123/300 |
| 5,313,924 | A * | 5/1994 | Regueiro | 123/456 |
| 5,345,916 | A * | 9/1994 | Amann et al. | 123/506 |
| 5,678,521 | A * | 10/1997 | Thompson et al. | 123/447 |
| 5,983,863 | A * | 11/1999 | Cavanagh et al. | 123/447 |
| 6,135,090 | A * | 10/2000 | Kawachi et al. | 123/446 |
| 6,609,500 | B1 * | 8/2003 | Ricco et al. | 123/446 |
| 6,668,800 | B1 * | 12/2003 | Ricco et al. | 123/446 |

* cited by examiner

*Primary Examiner*—Thomas Moulis
(74) *Attorney, Agent, or Firm*—Morrison & Foerster LLP

(57) ABSTRACT

A high-pressure pump is provided in order to supply fuel to the fuel rail of a common rail injection system in an internal combustion engine. The input-side control valve of the pump is closed during the pumping cycle in order to separate the inner chamber of the pump from the low-pressure side. According to the invention, the valve control pulse, by which means the control valve is closed, is active when the pressure wave generated by the upward movement of the pump plunger hits the control valve. The closing of the control valve is assisted by the impact of the pressure wave.

19 Claims, 5 Drawing Sheets

DEVICE AND METHOD FOR REGULATING THE CONTROL VALVE OF A HIGH-PRESSURE PUMP

CLAIM FOR PRIORITY

This application is a national stage of PCT/DE02/04501, published in the German language on Jul. 3, 2003, which claims the benefit of priority to German Application No. 101 62 988.5, filed on Dec. 20, 2001.

TECHNICAL FIELD OF THE INVENTION

The invention relates to a fuel pump for supplying fuel to the injection system of an internal combustion engine, to a fuel injection system, and to a method for operating such a fuel pump.

BACKGROUND OF THE INVENTION

Internal combustion engines with high-pressure direct injection are gaining increasingly in importance in engine construction. In common rail injection systems, as they are referred to, the fuel is delivered by means of a pump arrangement from the tank to a fuel rail which serves as a storage reservoir for the fuel. The fuel is already under high pressure in the fuel rail. The fuel can be injected directly into the cylinders via injection valves connected to the rail.

In order to be able to deliver the fuel at high pressure to the fuel rail, the pump arrangement comprises a high-pressure fuel pump. Fuel is fed to this fuel pump via a low-pressure inlet, and the fuel pressure is increased by means of the pump plunger. The fuel then reaches the fuel rail via the high-pressure outlet of the fuel pump.

In order that the necessary pressure can be generated in the inner chamber of the pump by means of upward movement of the pump plunger, the inner chamber of the pump must be separated from the low-pressure side at the start of the pumping process. In state-of-the-art solutions a control valve is provided for this purpose at the low-pressure inlet, which control valve can be closed by means of a valve control signal. It is necessary for this control valve to be closed reliably during the upward movement of the pump plunger so that the fuel pressure needed for the high-pressure direct injection can be built up in the inner chamber of the pump and in the fuel rail connected to the high-pressure outlet of the pump.

As well as the control valve on the input side, a high-pressure pump typically has another nonreturn valve arranged at the high-pressure outlet, which nonreturn valve is designed to prevent fuel flowing from the fuel rail back into the high-pressure pump.

DE 197 08 152 A1 discloses a fuel injection system having a forepump, a high-pressure feed pump and a storage line which is hydraulically connected to the high-pressure feed pump via a nonreturn valve. Injection valves of an internal combustion engine are connected to the storage line. The high-pressure feed pump has an overflow valve which is used for controlling the volume of fuel delivered to the storage line. The high-pressure feed pump has a pump chamber which is limited by a plunger. The plunger is driven via a drive shaft which has multiple cams. The volume of fuel and the fuel pressure under which fuel is delivered to the storage line are set depending on the movement of the plunger and the status of closure of the overflow valve.

In the event of the fuel pressure in the rail being low, for example shortly after the internal combustion engine has started, the nonreturn valve opens at a very early point because the pressure in the inner chamber of the pump exceeds the opposing pressure in the rail at a very early point. It can even happen that the nonreturn valve opens even before the control valve closes. In this case, no sufficiently high fuel pressure can build up in the fuel pump during the upward movement of the pump plunger because the fuel escapes via the nonreturn valve due to the low pressure in the rail. If the valve control pulse for closing the control valve is then emitted, the control valve is not closed or not kept closed as a consequence of the inadequate pressure inside the pump. As a result, fuel also escapes through the control valve back into the low-pressure circuit. The escaping fuel prevents a satisfactory build-up of pressure in the fuel rail. This problem makes itself felt in a negative way particularly when the engine is being started.

SUMMARY OF THE INVENTION

The invention provides a fuel pump and a method for operating a fuel pump wherein reliability is improved in closing the control valve on the low-pressure side.

The fuel pump according to the invention for supplying fuel to the injection system of an internal combustion engine has a low-pressure inlet via which fuel is fed to the fuel pump. In addition, the fuel pump has a high-pressure outlet as well as a control valve and a pump plunger. By means of the control valve, the fuel feed taking place via the low-pressure inlet can be interrupted depending on a valve control pulse. According to one embodiment of the invention, the valve control pulse for interrupting the fuel feed is active at the time at which the pressure wave generated by the upward movement of the pump plunger hits the control valve.

The invention is based upon the recognition that the static fuel pressure in the fuel pump is frequently insufficient to guarantee reliable closure of the control valve and that dynamic effects therefore have to be exploited in order to avoid the problems that occur in prior-art solutions.

A pressure wave is generated in the pump by the upward movement of the pump plunger. According to this embodiment of the invention, this pressure wave is exploited in order to assist the closing of the control valve. To this end, the control valve is then deliberately activated with the aid of the valve control pulse when the pressure wave assumes its maximum value at the location of the control valve. The valve control pulse has to be active at this time.

In the fuel pump according to another embodiment of the invention, it is ensured that the control valve is closed during the pumping cycle. Unlike the situation in prior-art solutions, the escape of fuel into the low-pressure circuit is prevented. As a result, the build-up of pressure in the inner chamber of the pump on the one hand and in the fuel rail on the other is improved and accelerated.

This is noticeable in particular in the start phase of the internal combustion engine, because in this phase the initial fuel pressure in the fuel rail is still very low and a high fuel pressure has therefore to be built up within a short period. By means of measurements in a real pump which was fitted with a control-valve regulator according to the invention, it was possible to demonstrate a significant reduction in the starting time.

Use of the fuel pump according to the invention enables in particular what is known as a high-pressure start, where a certain level of pressure has to apply in the rail for the initial injection.

It is advantageous if the pump plunger is driven by means of a pump cam mounted on a camshaft. In this way, when the engine speed is accelerated, the delivery rate of the fuel pump is also increased at the same time. The increased fuel requirement of the engine can be covered by this means.

It is advantageous if the valve control pulse is emitted with a delay of a defined delay period relative to the bottom dead center of the pump plunger. Whereas in prior-art high-pressure pumps the valve control pulse was emitted in each case at the start of the upward movement of the pump plunger, the valve control pulse in the solution according to the invention is emitted with a delay, namely when in each case the pressure wave generated by the upward movement of the plunger hits the control valve. The valve control pulse is emitted with a defined period of delay after the bottom dead center so as to ensure reliable closure of the control valve. The period of delay, which is dependent on the engine speed, can readily be taken into account when generating the valve control signal.

It is advantageous here if the time at which the valve control pulse is emitted is set by the point of maximum pump-plunger velocity during the upward movement of the pump plunger, inclusive of the travel time needed for the pressure wave to travel from the pump plunger to the control valve. In order to be able to use the dynamic effect of the pressure wave generated by the upward movement of the pump plunger to close the control valve, it must first be determined at what point in the upward movement of the plunger the maximum pressure occurs. The fuel pressure $\hat{p}$ depends, according to the formula $$\hat{p}=p\cdot c\cdot\hat{v}$$

on the fuel density $\rho$, the phase velocity or velocity of sound in the fuel c, and on the pump-plunger velocity $\hat{v}$. Since $\rho$ and c are constant, the maximum amplitude of the fuel pressure occurs at the point in the upward movement of the plunger at which the plunger velocity $\hat{v}$ is greatest. However, in order to determine the optimum time at which the valve control pulse should be emitted, the travel time of the pressure wave from the pump plunger to the control valve must also be taken into account. This taking into account of the pump geometry causes an additional delay in the time at which the valve control pulse should be emitted.

According to a further advantageous embodiment of the invention, the delay of the valve control pulse relative to the bottom dead center position is also reduced as the engine speed increases. Since the pressure in the fuel is proportional to the respective pump-plunger velocity and the pump-plunger velocities increase as the engine speed increases, higher engine speeds also result in higher pressures in the inner chamber of the pump. Therefore, when the engine speed is high, a sufficient pressure occurs at an early point, which amplitude can assist the closing of the control valve, and the period of delay can in this respect be reduced. An engine-speed-dependent delay in the valve control pulse enables in this respect optimum operation of the high-pressure pump.

It is advantageous if the delay of the valve control pulse is set as a delay angle relative to the camshaft angle corresponding to the bottom dead center position of the pump plunger. At a given engine speed, the period of delay by which the valve control pulse is to be delayed relative to the bottom dead center position can be converted into a correction angle in relation to the rotating camshaft or the rotating pump cam. After the bottom dead center position has been passed through, the camshaft has to continue turning by precisely this correction angle, and the valve control pulse has to be emitted then. By this means, the appropriate camshaft position can serve as a trigger for generating the valve control pulse. In an advantageous embodiment of the invention, the delay angle lies between 15° and 45°.

In an advantageous alternative embodiment of the invention, an extended valve control pulse is used as a valve control pulse, which extended pulse remains active until the time at which the pressure wave generated by the upward movement of the pump plunger hits the control valve. Instead of using a valve control pulse of constant length, which pulse is then delayed such that it is active at the time when the pressure wave hits the control valve, in this embodiment of the invention an extended valve control pulse is used, which is constantly transmitted at the same time. Here, the duration of the extended control pulse is selected such that the control pulse is still active when the pressure wave generated by the upward movement of the pump plunger hits the control valve. In this alternative embodiment of the invention, the pressure wave also assists the closing of the control valve. In particular, if an electromagnetically actuated control valve is used, in which the armature of the electrovalve is accelerated by means of a coil in the direction of the valve seat, the additional advantage is derived by using an extended valve control pulse that the magnetic field of the coil can be built up over a longer period of time. Because of the greater magnetic field strength which can be achieved by this means, the reliability of actuating the electrovalve is further increased.

It is advantageous here if the extension of the valve control pulse also decreases as the engine speed increases. With increasing engine speed, both the pump-plunger velocity and the pressure in the fuel increase. Higher engine speeds therefore also result in higher pressures in the inner chamber of the pump. When the engine speed is high, an adequate pressure which assists the closing of the control valve applies at an early point. At high engine speeds, the valve control pulse has to be extended less than at low engine speeds. The fuel pump can therefore be operated optimally by means of an engine-speed-dependent extension of the control pulse.

According to a further advantageous embodiment of the invention, the control valve concerned is an electromagnetically actuated control valve, and the valve control pulse concerned is an electrical valve control pulse. An electromagnetic control valve of this type has a coil by means of which a magnetic field can be generated. The armature of the electrovalve is accelerated by the magnetic field in the direction of the valve seat, and the valve is closed by this means. The electrical valve control pulse required to actuate the valve can be generated with the aid of an electrical or electronic regulation circuit. This enables precise control of the timing of the valve control pulse and consequently exact control of the timing of the closing of the valve.

It is advantageous if the fuel pump has at the high-pressure outlet a nonreturn valve which prevents any return flow of fuel from the injection system back into the fuel pump. As long as the pressure in the inner chamber of the pump is lower than the pressure in the fuel rail, the nonreturn valve remains closed. A return flow of fuel back into the pump, which return flow would reduce the high pressure generated in the fuel rail, can in this way be prevented. The nonreturn valve is opened if the pressure in the inner chamber of the pump is greater than the pressure in the fuel rail. With the aid of the nonreturn valve, the high pressure needed in the fuel rail can be built up in a short time.

Particularly in the case of a high-pressure start a certain pressure level is required in the rail for the initial injection, which pressure level can be built up in a short time if a nonreturn valve is used, so that the start time is shortened.

The fuel injection system according to the invention comprises in addition to a fuel pump according to the invention, a low-pressure pump which feeds fuel to the low-pressure inlet of the fuel pump and a fuel rail which is connected to the high-pressure outlet of the fuel pump. The fuel rail feeds the fuel needed to a number of injection valves. A pump arrangement which comprises a low-pressure pump and a high-pressure pump according to the invention enables a rapid build-up of pressure in the fuel rail. Particularly where the high-pressure pump according to the invention is used, a short start time is enabled in internal combustion engines with a common rail injection system.

It is advantageous here if the fuel rail has a pressure sensor which records the fuel pressure inside the fuel rail. It can in particular be determined by means of the pressure sensor whether the fuel pressure necessary in the rail for high-pressure direct injection has already been reached or not.

According to a further advantageous embodiment of the invention, the delivery rate of the fuel pump varies depending on the fuel pressure determined by the pressure sensor. The lower the actual fuel-pressure value measured in the fuel rail compared to the desired target fuel-pressure value, the higher the delivery rate of the fuel pump selected. The delivery rate of the fuel pump according to the invention is thus set with the aid of a control loop, whereby regulation of the delivery rate takes place depending on the difference between actual value and target value of the fuel pressure.

The method according to the invention serves to operate a fuel pump which delivers the fuel by means of a pump plunger and supplies fuel to an injection system via a high-pressure outlet. The fuel feed to the fuel pump taking place via a low-pressure inlet can be interrupted by means of a control valve depending on a valve control pulse. Here the valve control pulse is activated to interrupt the fuel feed at the time when the pressure wave generated by the upward movement of the pump plunger hits the control valve.

BRIEF DESCRIPTION OF THE DRAWINGS

The invention is further described below with reference to the exemplary embodiment illustrated in the drawings, in which.

DETAILED DESCRIPTION OF THE INVENTION

Figure 1:
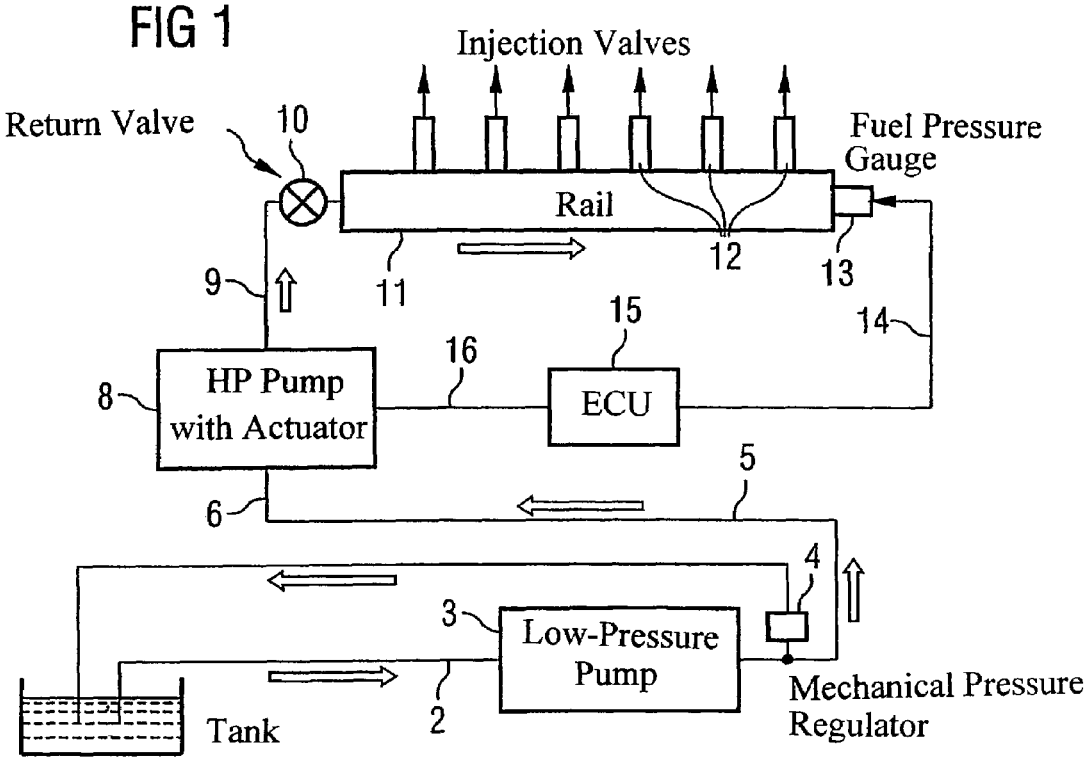
FIG. 1 shows an overview of a complete common rail injection system with a pump arrangement which comprises a low-pressure pump and a fuel pump.

FIG. 1 shows an overview of a common rail injection system for an internal combustion engine. The fuel passes from a tank 1 via a tank feeder line 2 to a low-pressure pump 3, which is preferably an electrical low-pressure pump. With the aid of a mechanical pressure regulator 4, the fuel volume delivered by the low-pressure pump 3 is regulated such that fuel is available at a suitable basic inlet pressure. Superfluous fuel passes back to the tank 1 via a tank return line 7. A volume-regulated low-pressure pump can also be used in place of the mechanical pressure regulator 4.

The function of the fuel pump 8 is to deliver the fuel fed via the low-pressure inlet 6 to a fuel rail 11. A certain pressure level in the fuel rail 11 is required for operating an internal combustion engine with high-pressure direct injection. The fuel pump 8, which can, for example, be fashioned as a single-plunger high-pressure pump, brings the fuel to the required high pressure level. The fuel passes via a high-pressure outlet 9 and a nonreturn valve 10 to the fuel rail 11 which serves as a storage reservoir for the fuel under high pressure. The nonreturn valve 10 prevents any return flow of fuel from the fuel rail 11 back to the fuel pump 8. A number of injection valves 12, via which the fuel can be injected directly into the respective cylinder interiors, are connected to the fuel rail 11.

The pressure prevailing in the fuel rail 11 can be recorded with the aid of the fuel pressure sensor 13. The pressure value measured is transmitted via a signal line 14 to a control unit 15, which is fashioned in the form of an engine control unit and compares the actual value of the fuel pressure in the rail with the target value and generates from the difference of the two values a regulating signal 16. The fuel pump 8 comprises a control valve 18 by means of which the delivery rate of the fuel pump 8 is regulated depending on the regulating signal 16. The more the actual value deviates from the target value, the higher is the delivery rate of the fuel pump 8 selected. The delivery rate is set by the time at which the control valve 18 closes in the pump lift.

Figure 2:
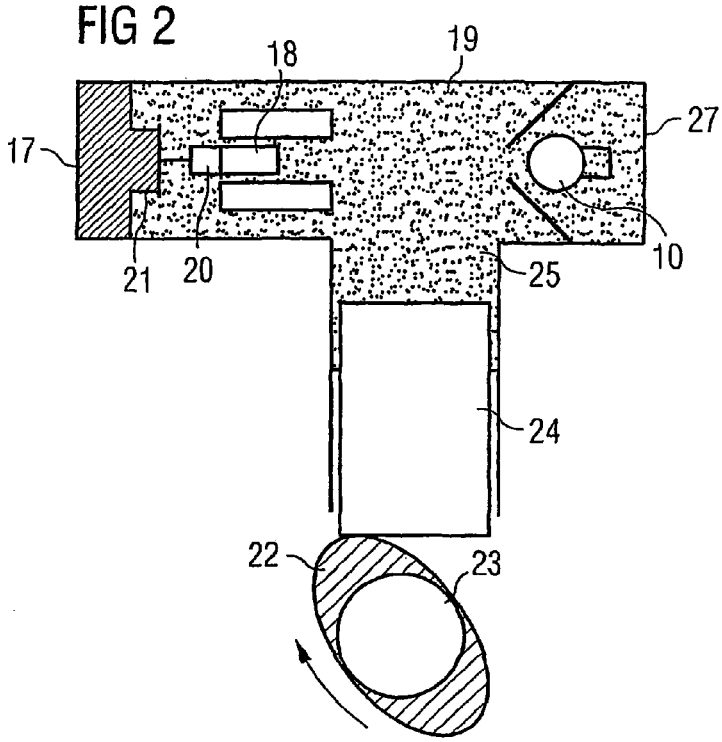
FIG. 2 shows a fuel pump in cross section.

FIG. 2 shows the structure of a single-plunger high-pressure pump in cross-section. Fuel is fed to the fuel pump via a low-pressure connection 17. The low-pressure connection 17 can be disconnected from the inner chamber of the pump 19 by closing off electromagnetic control valve 18. The control valve 18 has a closing element which can be pressed by an electromagnet against a valve seat 21 in order to close the low-pressure connection 17. The closing element here is subject to the pressure in the inner chamber of the pump 19, which pressure also presses the closing element with a force against the valve seat 21. The control valve 18 is fashioned as a control valve opening inwardly, i.e. in the direction of the pump inner chamber 19, which control valve opens against the pressure in the pump inner chamber 19.

To this end, a valve control pulse 16 is applied to the electromagnetic control valve 18 by the control unit 15 (see also FIG. 1). A magnetic field is built up by this means which accelerates an armature 20 of the valve in the direction of the valve seat 21 and thus closes the control valve 18. The control unit 15 is connected to a memory in which methods and characteristics fields which are needed for controlling the control valve 18 are stored.

A pump cam 22 is connected to a rotating camshaft 23. By means of the pump cam 22 a pump plunger 24 is moved alternately upward and downward. During the upward movement of the pump plunger 24 the control valve 18 is closed, then an increasing pressure is exerted on the fuel 25 located in the pump inner chamber 19 by means of the pump plunger 24. As soon as the fuel pressure in the pump inner chamber 19 is higher than the fuel pressure on the other side of the nonreturn valve 10 which is located on the side of a high-pressure connection 27, the nonreturn valve 10 opens, and the fuel 25 passes via the high-pressure connection 27 to the fuel rail of the injection system.

During the downward movement of the pump plunger 24, by contrast, the control valve remains open, and new fuel can pass from the low-pressure connection 17 into the pump inner chamber 19. During the downward movement of the pump plunger 24 the fuel pressure in the pump inner chamber 19 is lower than the fuel pressure on the other side of the nonreturn valve 10, that is on the side of the high-pressure connection 27, and the nonreturn valve 10 therefore remains closed during the downward movement of the pump plunger 24. This prevents fuel from being able to flow back from the fuel rail into the fuel pump.

Figure 3:
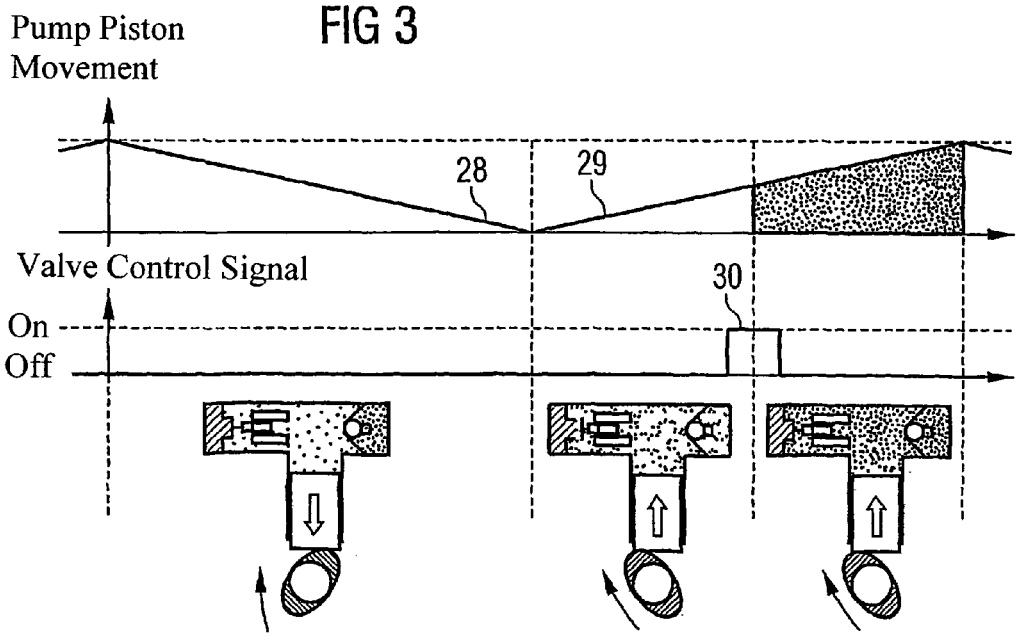
FIG. 3 shows the pump-plunger movement and of the valve control signal for the various phases run through by the fuel pump.

FIG. 3 shows an overview of the various phases which occur in the operation of a single-plunger high-pressure pump. During a downward movement 28 of the pump plunger the control valve is open, and fuel flows from the low-pressure inlet into the pump inner chamber. The nonreturn valve is closed here.

Upon a subsequent upward movement 29 of the pump plunger, the control valve is initially still open. The control valve is closed by means of a valve control pulse 30. Upon the further upward movement of the pump plunger a pressure builds up in the inner chamber of the pump, which pressure opens the nonreturn valve. The fuel is pushed from the inner chamber of the pump via the high-pressure connection into the fuel rail.

Figure 4:
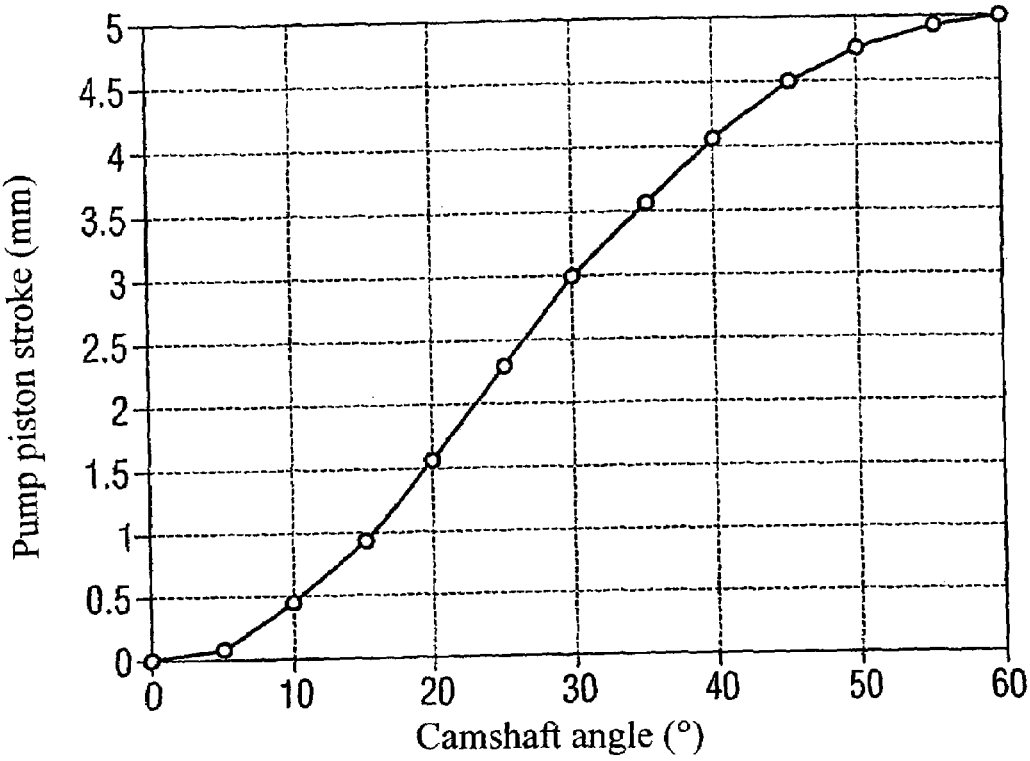
FIG. 4 shows a graph plotting the pump-plunger lift as a function of the camshaft angle.

FIG. 4 records the pump-plunger elevation (in mm) as a function of the camshaft angle (in degrees) for the upward movement of the pump plunger, which elevation is available to the control unit as a characteristic curve. The question arises of at what point during the upward movement of the pump plunger the valve control pulse for closing the control valve should be emitted.

In prior-art solutions the valve control pulse was emitted at the start of the upward movement of the pump plunger, i.e. shortly after the bottom dead center of the pump plunger had been passed through.

In the event of the fuel pressure in the fuel rail being low, it has happened that the nonreturn valve is opened at a very early point, that is, even before the control valve has closed. In this case no sufficiently high fuel pressure can build up in the inner chamber of the pump during the upward movement of the pump plunger since the fuel escapes via the nonreturn valve due to the low pressure in the fuel rail.

If the valve control pulse is then emitted, the control valve cannot be closed or cannot be kept closed as a result of the pressure in the inner chamber of the pump being too low. During the further upward movement of the pump plunger, fuel therefore also escapes through the control valve back into the low-pressure circuit. The escaping fuel prevents a rapid build-up of pressure in the fuel rail, and this affects adversely the behavior of the injection system, particularly on start-up.

Figure 5:
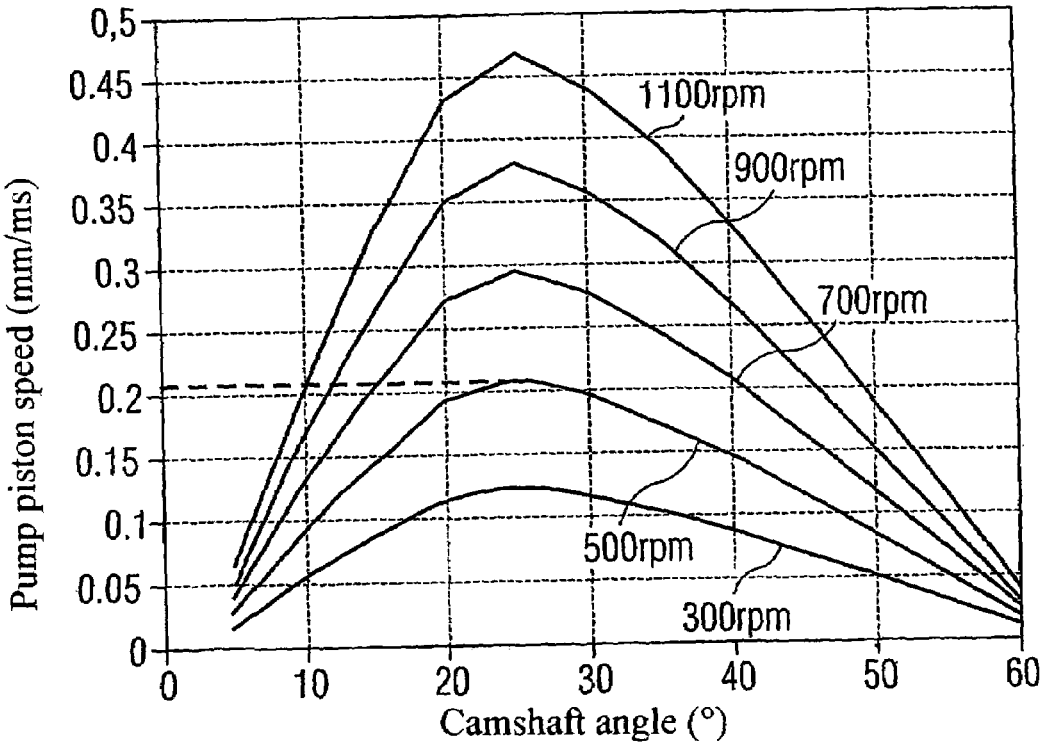
FIG. 5 shows a graph plotting the pump-plunger velocity as a function of the camshaft angle for different engine speeds.

In order to ensure reliable closing of the control valve, dynamic affects in the pump are utilized in the solution according to the invention. To this end, FIG. 5 records the pump-plunger velocity (in mm/ms) for various engine speeds as a function of the camshaft angle (in degrees). These characteristic curves are available to the control unit. Depending on the shape of the pump cam, the maximum pump-plunger velocity in the fuel pump to which the curves relate is reached at a camshaft angle of approximately 250.

The correlation between the velocity amplitude $\hat{v}$ of the pump plunger and the fuel pressure $\hat{p}$ can be produced with the aid of the formula $$\hat{p}=p\cdot c\cdot\hat{v}$$

where ρ designates the density of the fuel, and where c designates the phase velocity or sound velocity of a longitudinal wave in the fuel. Since ρ and c are constants, direct proportionality is produced between the velocity $\hat{v}$ of the pump plunger and the fuel pressure $\hat{p}$.

In respect of the phase velocity or sound velocity c of a longitudinal wave in a liquid, the following applies:

$$c=\sqrt{\frac{K}{\rho}}=\sqrt{\frac{1}{\chi\cdot\rho}}$$

Here ρ designates the density of the fuel, K the compression module and X the compressibility of the fuel.

A sufficiently high pressure at the control valve would cause a rapid and reliable closing of the control valve. At the pump plunger, the maximum pressure occurs at the point of upward movement at which the pump-plunger velocity is greatest. In the example shown in FIG. 5, this is the case at a camshaft angle of approximately 25°.

However, in order now to be able to utilize the maximum pressure at the location of the control valve to close the control valve, the travel time of the pressure wave from the pump plunger to the control valve has also to be taken into account. This time, which is determined by the pump geometry and which is needed for the pressure to travel has to be taken into account in the form of an additional delay in the valve control pulse.

According to the invention, the valve control pulse for closing the control valve is emitted at the point with the greatest pump-plunger velocity, also taking into account the pump geometry. In this procedure the control pulse for the control valve is emitted precisely when the pressure wave caused by the upward movement of the pump plunger hits the control valve. Even if the static pressure conditions are not sufficient to ensure reliable closing of the control valve, the taking into account according to the invention of the additional dynamic effect of the pressure wave hitting the control valve enables reliable closing of the control valve.

Figure 6:
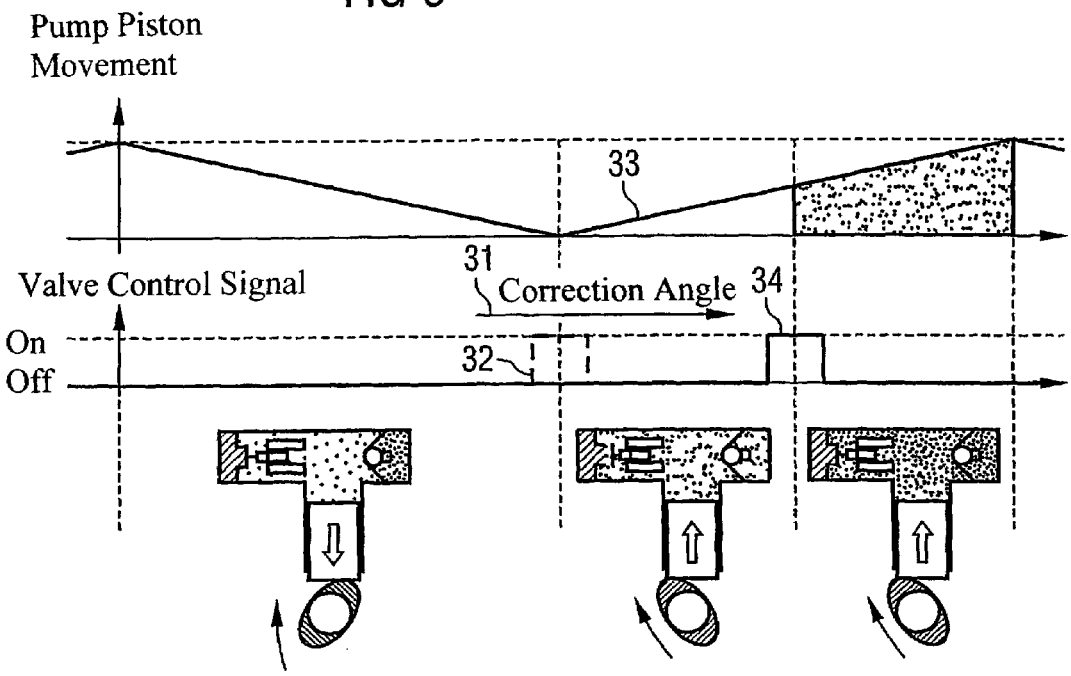
FIG. 6 shows the position of the valve control pulse, displaced by a correction angle, relative to the pump-plunger movement.

The necessary delay in the valve control pulse can be given as a correction angle relative to the bottom dead center position. FIG. 6 shows how the former valve control pulse 32 which in prior-art solutions was emitted at the start of the upward movement 33 of the pump plunger, is by means of the correction angle 31 emitted with a delay. The valve control pulse 34 according to the invention triggers the closing of the control valve precisely when the arriving pressure wave assists the closing process. Values for the correction angle depending on the load and/or engine speed of the internal combustion engine and/or the pressure in the fuel rail are stored in the memory of the control unit.

Figure 7:
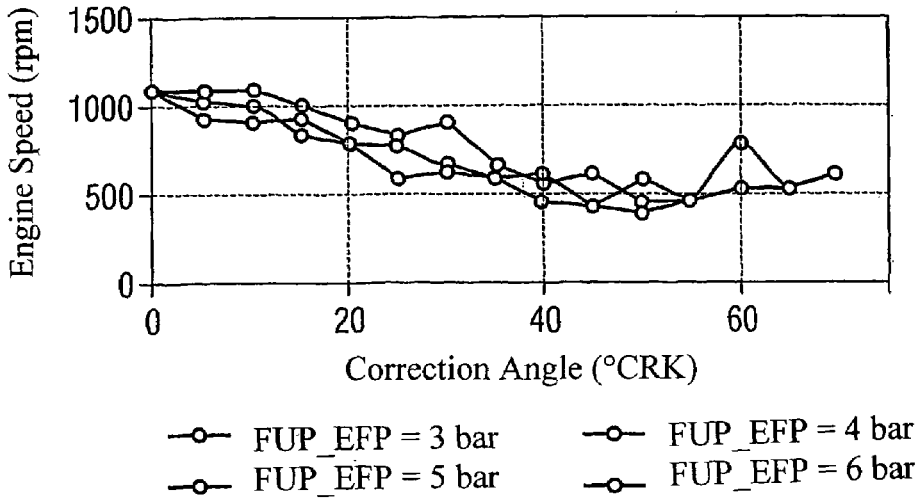
FIG. 7 shows the minimum engine speed required for building up pressure in the rail as a function of the correction angle.

FIG. 7 plots a characteristic curve for the minimum engine speed which is needed for the pressure build-up in the fuel rail as a function of the correction angle used. If the correction angle selected is relatively large, then the pressure needed in the rail can be built up even at a relatively low engine speed. The characteristic curve is stored in the memory of the control unit. The reason for the reduction in the minimally required engine speed is that the pressure wave caused by the pump plunger has already reached the control valve at the time when the valve control pulse is emitted, and consequently a pressure prevails at the control valve which is sufficient for reliably closing the valve. With smaller correction angles, this is only the case if the engine speed and thus also the pump-plunger velocity are sufficiently high. If the engine speed exceeds a maximum value of, for example, 1200 revs/min, then no correction is needed any longer and the valve control pulse can close the control valve at the time when the desired delivery rate is reached.

Figure 8:
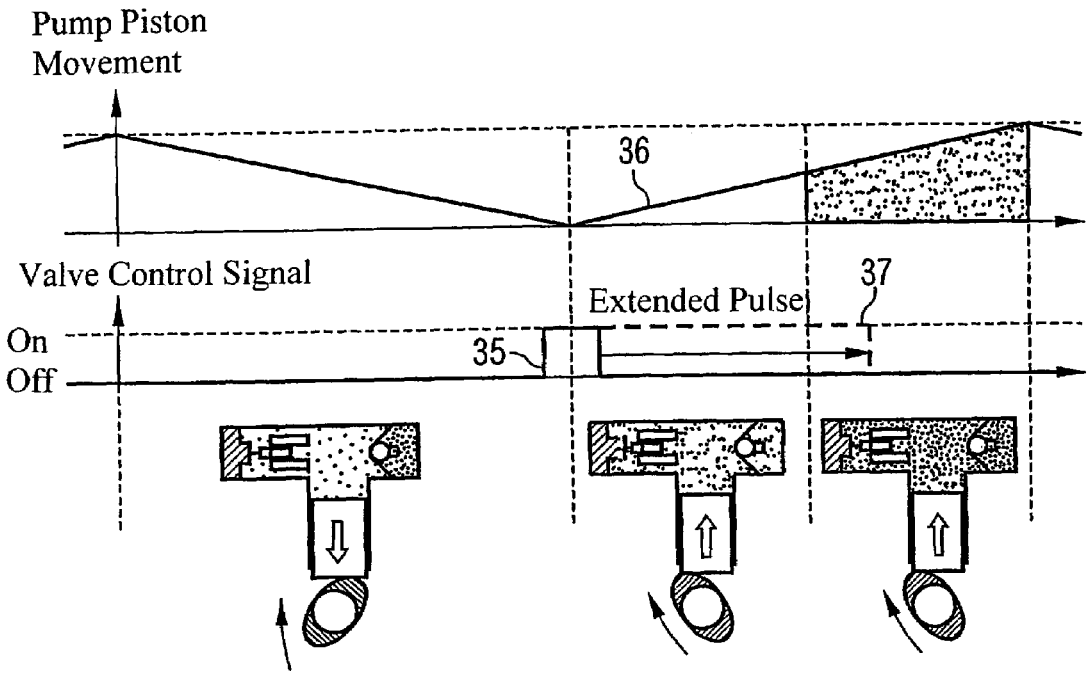
FIG. 8 shows a second embodiment of the invention and the position of the extended valve control pulse relative to the pump-plunger movement.

FIG. 8 shows a second embodiment of the invention in which the valve control pulse is extended. In prior-art solutions, a valve control pulse 35 of defined length was emitted at the start of the upward movement 36 of the pump plunger. According to the second embodiment of the invention, an extended valve control pulse 37 is used in place of the valve control pulse 35, which extended pulse is still active when the pressure wave caused by the pump-plunger movement arrives. Values for the temporal extension of the control pulse depending on the load and/or engine speed of the internal combustion engine, depending on the pressure in the fuel rail and depending on the correction angle are stored in the memory of the control unit. In this second embodiment of the invention, the closing of the control valve is also assisted by the pressure wave, so that a reliable closure and a rapid build-up of pressure are ensured. In addition, more energy is applied to a magnet coil of the control valve through the extension of the valve control pulse. It is possible as a result to reduce the level of pressure necessary for closing the valve. Of course, a combination of a valve control pulse whose timing is delayed relative to the bottom dead center as per FIG. 6 and a temporally extended valve control pulse as per FIG. 8 is also possible.

Figure 9:
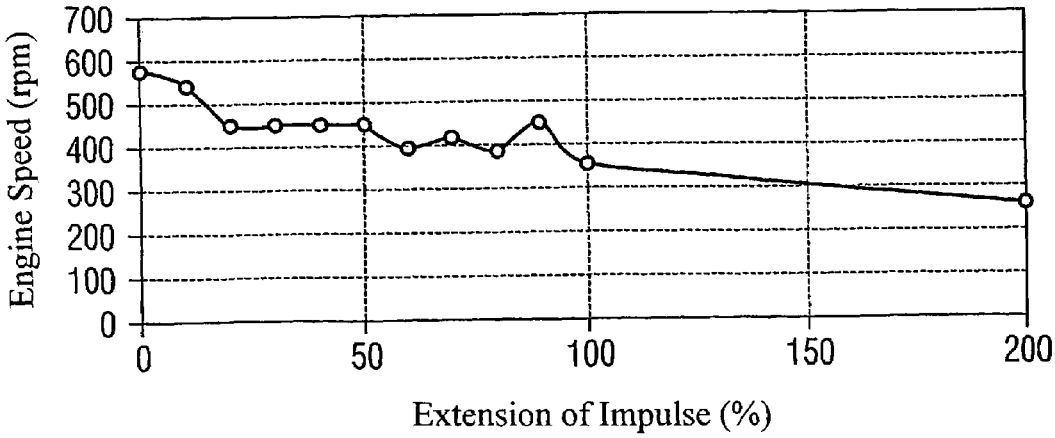
FIG. 9 shows a graph plotting the measurement results which shows the interconnection between the percentage extension of the valve control pulse and the engine speed.

Using the measurement results shown in FIG. 9 it can be seen that by extending the valve control pulse it is possible to reduce significantly the minimally required engine speed for building up the pressure. With extended valve control pulses, the pressure wave caused by the pump-plunger movement helps to close the valve, and lower pressures therefore suffice where there are longer valve control pulses. Due to the proportionality between pump-plunger velocity and pressure, this also means that a lower pump-plunger velocity and consequently also a lower engine speed are sufficient in order to provide the pressure necessary to close the valve. Where short valve control pulses are used, by contrast, high engine speeds continue to be necessary. The characteristic curve of FIG. 9 is stored in the memory of the control unit.

The invention is particularly advantageous upon start-up of the internal combustion engine, in which case the actual pressure in the fuel rail 11 is lower than a desired target pressure. According to the previous control methods, the control valve 18 in this situation was closed when the pump plunger 24 was in the bottom dead center position so as to set a maximum delivery rate of the high-pressure pump. In contrast to this procedure, the control valve 18 is not closed until later and a maximum delivery rate is waived in favor of reliable closing of the control valve 18.

What is claimed is:

1. A fuel pump for supplying fuel to an injection system of an internal combustion engine, comprising:

a low-pressure inlet via which fuel is fed to the fuel pump;

a control valve by means of which the fuel feed being carried out via the low-pressure inletis configured for interruption based on a valve control pulse which has been emitted by a control unit;

a pump plunger; and a high-pressure outlet, wherein the valve control pulse for interrupting the fuel feed is active at the time at which a pressure wave generated by an upward movement of the pump plunger hits the control valve.

2. The fuel pump according to claim 1, wherein the pump plunger is driven by a pump cam mounted on a camshaft.

3. The fuel pump according to claim 1, wherein the control unit emits the valve control pulse with a delay of a defined period of delay relative to a bottom dead center of the pump plunger.

4. The fuel pump according to claim 1, wherein the control unit sets the time at which the valve control pulse is emitted by the point of maximum pump-plunger velocity during the upward movement of the pump plunger, including travel time for the pressure wave to travel from the pump plunger to the control valve.

5. The fuel pump according to claim 3, wherein the control unit reduces the period of delay of the valve control pulse relative to the bottom dead center position of the pump plunger as the engine speed increases.

6. The fuel pump according to claim 3, wherein the control unit sets the period of delay of the valve control pulse as a correction angle relative to a camshaft angle corresponding to the bottom dead center position of the pump plunger.

7. The fuel pump according to claim 1, wherein the control unit uses as a valve control pulse an extended valve control pulse which remains active until the time at which the pressure wave generated by the upward movement of the pump plunger hits the control valve.

8. The fuel pump according to claim 7, wherein the control unit sets the time until which the extended valve control pulse remains active by the point of maximum pump-plunger velocity during the upward movement of the pump plunger including the travel time needed for the pressure wave to travel from the pump plunger to the control valve.

9. The fuel pump according to claim 7, wherein the control valve is an electromagnetically actuated control valve, and the valve control pulse is an electrical valve control pulse.

10. The fuel pump according to claim 1, wherein the fuel pump has a nonreturn valve at the high-pressure outlet, which nonreturn valve prevents any return flow of fuel from a fuel rail back to the fuel pump.

11. A method for operating a fuel pump, comprising:

delivering fuel by a pump plunger; and supplying the fuel via a high-pressure outlet to an injection system, wherein the fuel feed via a low-pressure inlet to the fuel pump is configured for interruption by a control valve depending on a valve control pulse, wherein application of the valve control pulse at the control valve for interrupting the fuel feed at a time at which a pressure wave generated by an upward movement of the pump plunger hits the control valve.

12. The method according to claim 11, wherein the pump plunger is driven by a pump cam mounted on a camshaft.

13. The method according to claim 11, wherein the valve control pulse is emitted with a delay of a defined period of delay relative to a bottom dead center of the pump plunger.

14. The method according to claim 11, wherein the time at which the valve control pulse is emitted is set depending on a maximum pump-plunger velocity during the upward movement of the pump plunger including the travel time needed for the pressure wave to travel from the pump plunger to the control valve.

15. The method according to claim 11, wherein the period of delay of the valve control pulse relative to a bottom dead center of the pump plunger is reduced as engine speed increases.

16. The method according to claim 11, wherein the period of delay of the valve control pulse is set as a correction angle relative to a camshaft angle corresponding to a bottom dead center position of the pump plunger.

17. The method according to claim 11, wherein an extended valve control pulse is used as the valve control pulse, which extended valve control pulse remains active until the time at which the pressure wave generated by the upward movement of the pump plunger hits the control valve.

18. The method according to claim 17, wherein the time until which the extended valve control pulse remains active is set by the point of maximum pump-plunger velocity during the upward movement of the pump plunger including travel time for the pressure wave to travel from the pump plunger to the control valve.

19. A fuel injection system, comprising:

a fuel pump;

a low-pressure pump which feeds fuel to a low-pressure inlet of the fuel pump; and a fuel rail which is connected to the high-pressure outlet of the fuel pump and which feeds the fuel needed to the injection valves, wherein the fuel pump supplies fuel to the injection system of an internal combustion engine, the low-pressure inlet feeds fuel to the fuel pump, a control valve by means of which the fuel feed being carried out via the low-pressure inlet is configured for interruption based on a valve control pulse which has been emitted by a control unit, a pump plunger, the high-pressure outlet, and the valve control pulse for interrupting the fuel feed is active at the time at which a pressure wave generated by an upward movement of the pump plunger hits the control valve.

* * * * *